US006572369B2

(12) United States Patent
Linke

(10) Patent No.: US 6,572,369 B2
(45) Date of Patent: Jun. 3, 2003

(54) TUNNEL KILN, AND BURNER FOR USE IN A TUNNEL KILN

(75) Inventor: Walter Linke, Mauerbach (AU)

(73) Assignee: Wienerberger Ziegelindustrie AG, Vienna (AT)

( * ) Notice: Subject to any disclaimer, the term of this patent is extended or adjusted under 35 U.S.C. 154(b) by 0 days.

(21) Appl. No.: 09/946,198

(22) Filed: Sep. 5, 2001

(65) Prior Publication Data

US 2002/0136998 A1 Sep. 26, 2002

Related U.S. Application Data

(63) Continuation of application No. 09/676,109, filed on Sep. 29, 2000.

(30) Foreign Application Priority Data

Mar. 22, 2000 (AT) ..... A 484/00

(51) Int. Cl.[7] ..... F27B 9/36
(52) U.S. Cl. ..... 432/146; 264/652
(58) Field of Search ..... 432/121, 137, 432/146, 149, 190, 122; 264/630, 652; 202/88

(56) References Cited

U.S. PATENT DOCUMENTS

| | | | | | |
|---|---|---|---|---|---|
| 2,991,535 | A | * | 7/1961 | Hanley | 432/190 |
| 4,192,645 | A | * | 3/1980 | Hassler | 432/149 |
| 4,240,788 | A | * | 12/1980 | Naito et al. | 432/136 |
| 4,329,142 | A | * | 5/1982 | Dyer | 432/144 |
| 4,490,107 | A | | 12/1984 | Kimura et al. | |
| 4,773,851 | A | * | 9/1988 | Mueller | 432/48 |
| 4,790,749 | A | * | 12/1988 | Mauro | 432/175 |
| 5,613,847 | A | * | 3/1997 | Lingl | 432/133 |
| 5,906,485 | A | * | 5/1999 | Groff et al. | 432/146 |

FOREIGN PATENT DOCUMENTS

| | | |
|---|---|---|
| DE | 15 08 595 A | 10/1969 |
| DE | 29 51 365 B | 3/1981 |
| DE | 31 47 582 A1 | 6/1983 |
| DE | 33 05 540 A | 9/1984 |
| DE | 44 42 850 A1 | 6/1995 |
| DE | 44 38 417 A | 4/1996 |
| DE | 196 08 565 A1 | 9/1996 |
| DE | 296 14 958 U | 1/1998 |
| EP | 42 372 A1 | 12/1981 |
| EP | 335 615 A1 | 10/1989 |
| FR | 79 657 E | 4/1963 |
| GB | 1 040 481 A | 8/1966 |
| WO | WO 93 25360 A | 12/1993 |
| WO | WO 94 04329 A1 | 3/1994 |

* cited by examiner

*Primary Examiner*—Gregory Wilson
(74) *Attorney, Agent, or Firm*—Henry M. Feiereisen

(57) ABSTRACT

A tunnel kiln useful for burning vertically perforated green bricks, includes a furnace chamber; a plurality of tubular burners for heating the furnace chamber, with the burners defined by longitudinal axes which extend essentially in a vertical direction; and a transport device for so transporting green bricks in raster-like spaced-apart relationship in a travel direction through the furnace chamber that the perforations of the green bricks are oriented in a common direction. Each of the burners has a nozzle body formed with orifices for combustion gases, with the orifices defined by longitudinal axes which extend substantially in a direction of the perforations, wherein the nozzle body is positioned within a spacing between confronting end faces of neighboring green bricks.

14 Claims, 3 Drawing Sheets

TUNNEL KILN, AND BURNER FOR USE IN A TUNNEL KILN

CROSS-REFERENCES TO RELATED APPLICATIONS

This application is a continuation of prior filed copending application Ser. No. 09/676,109, filed Sep. 29, 2000.

This application claims the priority of Austrian Patent Application, Serial No. 484/2000, filed Mar. 22, 2000, the subject matter of which is incorporated herein by reference.

BACKGROUND OF THE INVENTION

The present invention relates to a tunnel kiln useful for vertically perforated bricks.

Tunnel kiln are known in which unfired or green bricks are placed in raster-like spaced-apart relation on a transport device for travel through the heated furnace chamber of the kiln such that the vertical or slot perforations of all bricks are oriented in a common direction. Heating of the furnace chamber is implemented by tubular burners which are defined by longitudinal axes extending substantially in vertical direction.

Such kilns are normally configured in two designs: Some conventional kilns use a small number of burners which produce a high heat output. These burners generate temperatures at a degree that is unsuitable for direct exposure of the green bricks. Therefore, the burners are positioned at a distance to the green bricks and so aligned that the produced hot gases reach the green bricks only indirectly. Other kilns use a plurality of small burners which are typically secured in the roof of the kiln, whereby each burner generates only a small heat output.

Although the burners used in these conventional kilns are capable to produce sufficient temperatures, their efficiency of the firing action is not satisfactory because heat does not sufficiently circulate around and through the green bricks. Large, energy-rich burners permit only an indirect and untargeted heat circulation of the green bricks so that a significant flow through the brick perforations cannot be established. Small burners generate only a relative slow circulation which is incapable to fully penetrate through the bricks, in particular high-volume green bricks, even when directly targeted at the green bricks.

SUMMARY OF THE INVENTION

It is thus an object of the present invention to provide an improved tunnel kiln, obviating the afore-stated drawbacks.

In particular, it is an object of the present invention to provide an improved tunnel kiln which realizes an significantly more efficient burning action.

It is another object of the present invention to provide an improved burner for use in a tunnel kiln according to the present invention.

These objects, and others which will become apparent hereinafter, are attained in accordance with the present invention by providing a plurality of tubular burners for heating a furnace chamber, with the burners defined by longitudinal axes which extend essentially in a vertical direction; and a transport device for so transporting green bricks in raster-like spaced-apart relationship in a travel direction through the furnace chamber that the perforations of the green bricks are oriented in a common direction, wherein each of the burners has a nozzle body formed with orifices for combustion gases and positioned within a spacing between confronting end faces of neighboring green bricks, with the orifices of the nozzle body defined by longitudinal axes which extend substantially in a direction of the perforations of the green bricks.

Through the structure and disposition of the burner nozzle body with multiple orifices, the hot gas streams, produced by the burners, are mainly jetted out directly into the slot perforations of the green bricks so that the perforations are intensely penetrated by hot gases. Thus, all surfaces, in particular those areas of the perforations that have been neglected by conventional kilns, are exposed to intense hot gas streams. As a consequence, the green bricks are completely burnt after a relatively short time so as to establish a particularly economical procedure.

According to another feature of the present invention, the nozzle body has two groups of such orifices, whereby the orifices of each group is arranged along a line, with the groups of orifices being offset to one another by 180°. In this way, a burner is capable to burn two rows of green bricks simultaneously with hot gases, so that the total number of burners can be reduced, without adversely affecting the efficiency of the burning process. Suitably, the perforations of all green bricks extend transversely to the travel direction. Thus, there is no need to move the burners along their longitudinal axes. Rather the burners can be fixedly mounted immobile in a simple manner to the ceiling or roof of the furnace chamber.

According to another feature of the present invention, the burners are configured as high-speed burners. High-speed burners produce hot gases at particularly great flow speeds. At such speeds, ambient air is entrained so that the volume of the gas flow produced by the burner is significantly increased. This entrainment of air permits the operation of the burner with a relatively small flame and thus in a very energy-efficient manner, while still producing an intense hot gas stream, Suitably, the burners may have a core flow speed of 30 to 60 m/s, preferably 40 to 50 m/s. At such speeds, the ratio of fuel supplied to the burners and burning energy introduced into the green bricks is optimized.

According to yet another feature of the present invention, each of the burners has an outer tube formed with the orifices and closed at its lower end in the area of the nozzle body, an inner tube received in the outer tube and having a lower end disposed above the nozzle body, and a disk-shaped mixer closing the lower end of the inner tube. This configuration of the burners is less prone to malfunction, and ensures a discharge of combustion gases from all orifices at same speeds, so that the green bricks are evenly burnt across their entire height.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
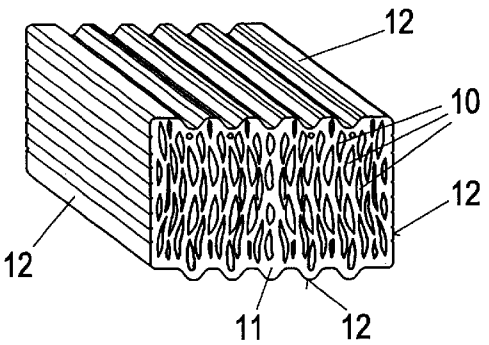
Fig. 1 (PRIOR ART)
FIG. 1 is a perspective illustration of a typical vertically perforated green brick.

Throughout all the Figures, same or corresponding elements are generally indicated by same reference numerals.

Turning now to the drawing, and in particular to FIG. 1, there is shown a perspective illustration of a typical unfired or green brick, generally designated by reference numeral 1 and typically made from raw brick material composed of a mixture of clay, water and, optionally, other suitable additives. The green brick 1 involved here is of the vertically perforated type with slot perforations 10 of generally elongate cross section to form continuous vertical channels. In the following description, the boundary surfaces at which the perforations 10 of the green bricks 1 terminate will be designated as end faces 11, while the remaining boundary surfaces are designated as sidewalls 12. Thus, the perforations 10 traverse the green bricks 1 and terminate in the opposite end faces 11.

Figure 2:
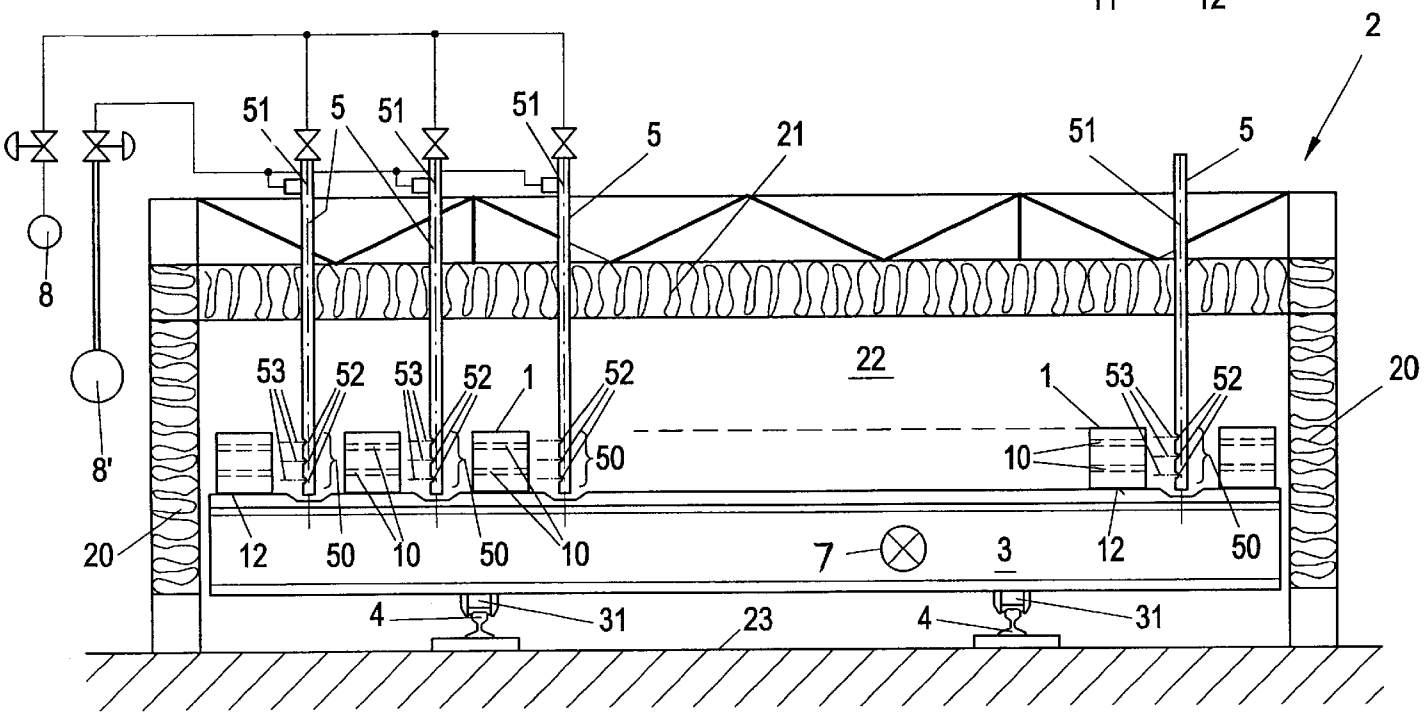
FIG. 2 is a vertical section of a tunnel kiln according to the present invention.
Figure 3A:
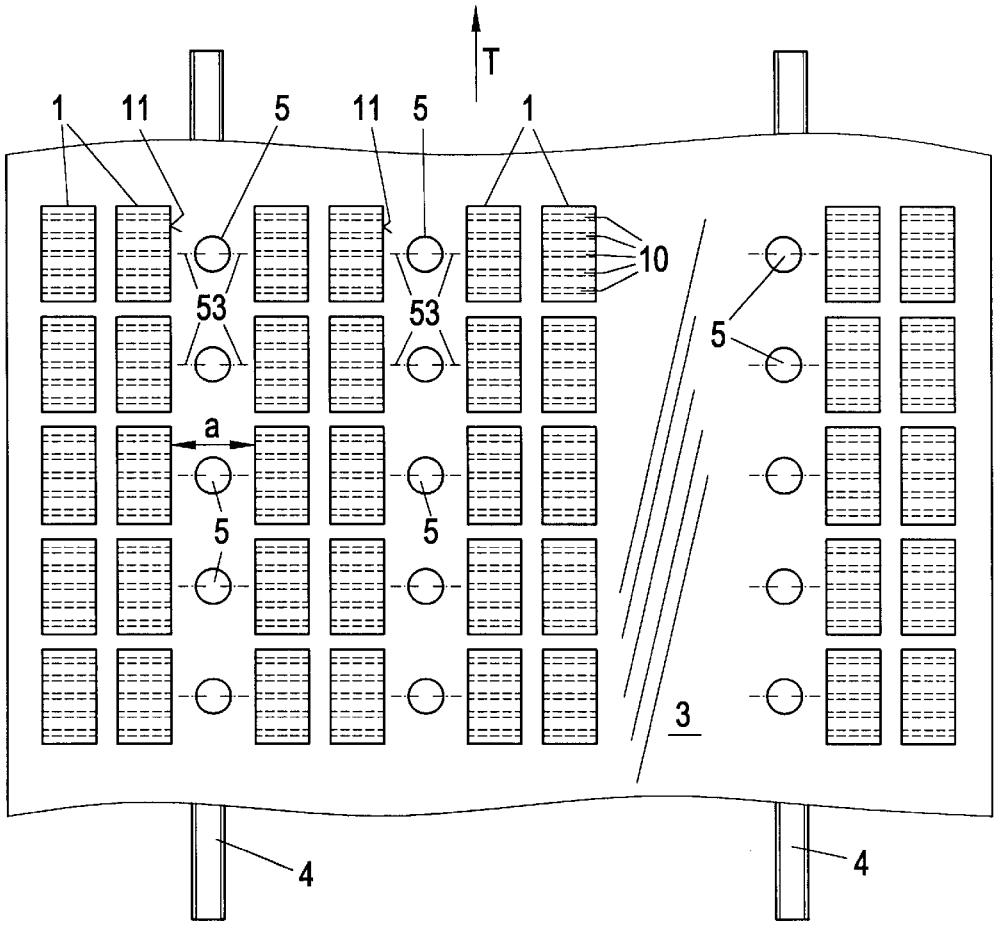
FIG. 3*a* is a cutaway plan view of a kiln car loaded with green bricks with their slot perforations oriented transversely to the travel direction.

Referring now to FIG. 2, there is shown a basic configuration of a tunnel kiln 2 according to the present invention. The tunnel kiln 2 has a furnace chamber which forms a tunnel-shaped firing zone 22 and is confined by walls 20 of heat-insulating material and a ceiling 21 of heat-insulating material which is secured to the walls 20. The green bricks 1 to be burnt are loaded in raster-like spaced-apart configuration on a transport device 3 which moves perpendicular to the plane of FIG. 1 in a traveling direction T (FIG. 3*a*). Typically, the transport device 3 includes cars which are supported on wheels 31 for running along a track system 4 mounted on the floor 23 of the furnace chamber. Persons skilled in the art will understand that the transport device may, of course, be configured in a different manner so long as it is suitable to move the green bricks I through the firing zone 22, e.g. belts, air cushions, rods or the like.

The green bricks 1 are loaded with one of their sidewalls 12 on the transport device 3 so that their end faces 11 extend perpendicular to the traveling direction T of the transport device 3, with the perforations 10 of the green bricks 1 extending in a common direction, preferably transversely to the travel direction T, as shown in FIGS. 2 and 3*a*.

The tunnel kiln 2 is heated by a plurality of tubular burners 5 which are guided through the ceiling 21 to the outside of the furnace chamber for connection to burner gas and air supply conduits 8, 8'. The burners 5 define longitudinal axes 51 which extend substantially in a vertical direction. As the burners 5 are of an identical construction, it will be understood by persons skilled in the art that a description of one of the burners 5 is equally applicable to the other burners 5. Each burner 5 has an outer tube 6 (FIG. 4) with a nozzle body 50 which is positioned within a distance a between confronting end faces 11 of neighboring green bricks 1, as best seen in FIG. 3*a*. The outer tube 6 of the burner 5 is formed in the nozzle body 50 with orifices 52 for jetting out combustion gases produced by the burner 5. The orifices 52 define longitudinal axes 53 which extend substantially in the direction of the perforations 10, i.e. transversely to the travel direction T, so that combustion gases produced by the burners 5 are introduced directly into the perforations 10.

The number of orifices 52 per burner 5 can be randomly selected and can be best suited to the situation at hand. However, the nozzle body 50 of the burners 5 should be so sized as to cover the entire height of the green bricks 1 so that the green brick 1 can be burnt evenly across their entire height. Practice has shown that the provision of eight orifices 52 is appropriate when the nozzle body 50 has a length of about 340 mm, with the orifices 52 evenly or irregularly spaced along the nozzle body 50.

In the nonlimiting example of the tunnel kiln 2, shown in FIG. 2, the orifices 52 of each burner 5 are arranged in a vertical line and confront the end faces 11 of the green bricks 1 located to the left of the burners 5. Thus, combustion gases produced by the burners 5 act only upon a single row of green bricks 1.

Figure 3B:
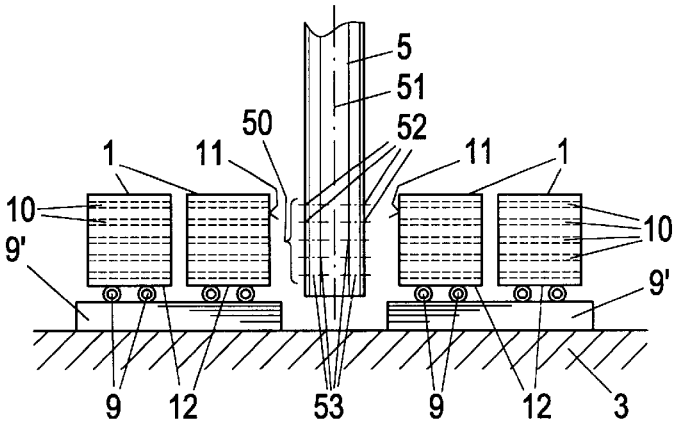
FIG. 3*b* is a cutaway side elevation of the kiln car of FIG. 3*a;*.
Figure 4:
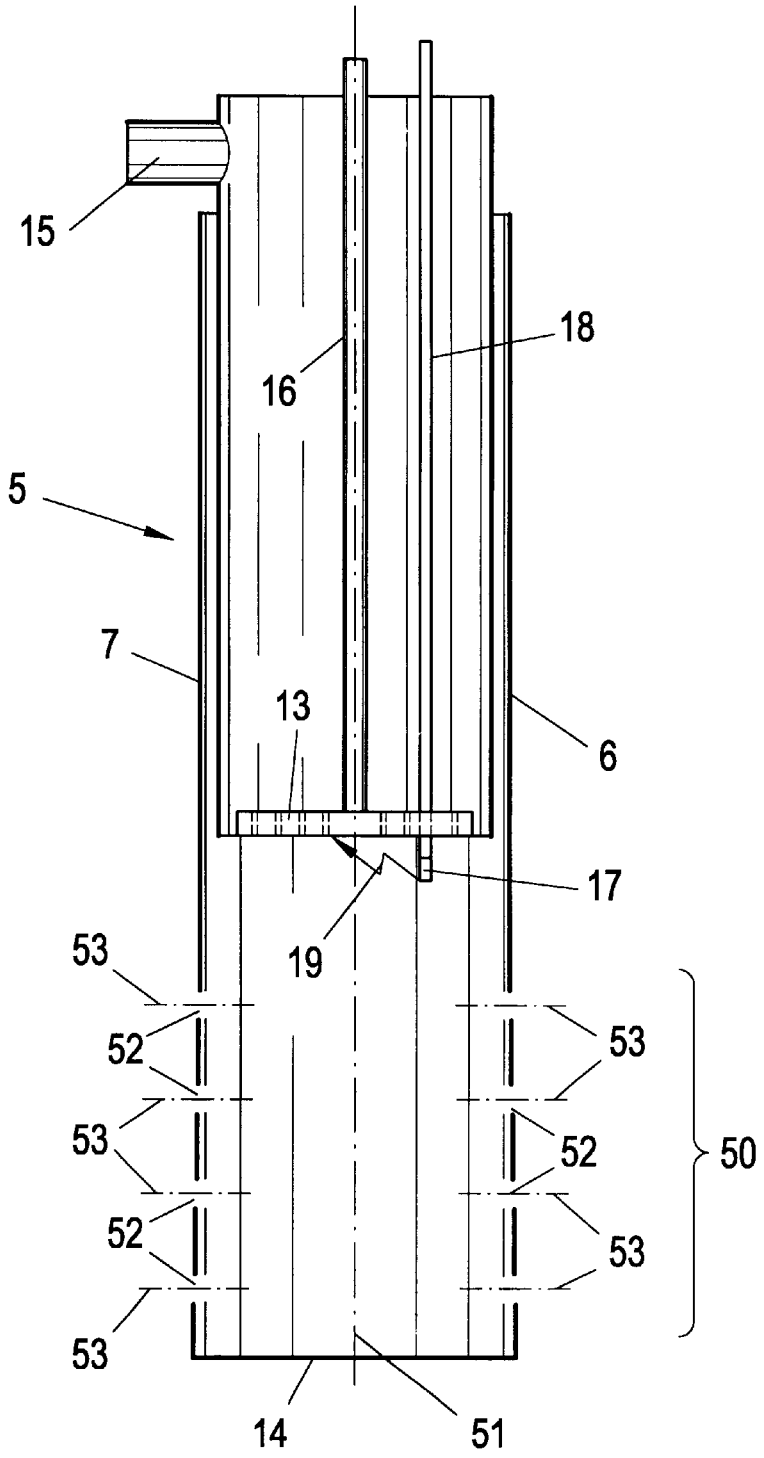
FIG. 4 is a sectional view of one embodiment of a burner for use in the tunnel kiln according to the present invention.

FIGS. 3*a* and 3*b* show a modified configuration of the nozzle body 50 of each burner 5. Here, the orifices 52 are combined to two groups, with each group of orifices 52 extending along a line in parallel relation to the longitudinal axis 51 of the burner 5. Both groups of orifices 52 are arranged in the outer tube 6 offset to one another by 180°, so that the orifices 52 of both groups are arranged in pairs in opposite disposition, as also shown in FIG. 4. This configuration of each burner 5 permits simultaneous burning of two rows of green bricks 1 that neighbor the burner 5, as shown in FIG. 3*b*.

As shown in FIG. 3*a*, the green bricks 1 are loaded on the transport device 3 in several rows in travel direction T, with each row including several green bricks 1 loaded in groups of two. The spacing within each group of two is relatively small whereas the spacing a between neighboring groups of two is so wide as to permit disposition of the nozzle body 50 of the burners 5 within the spacing a. Several burners 5 are positioned in succession in each spacing a so that each green brick 1 is exposed several times to the hot combustion gases during passage through the firing zone 22.

As shown in FIG. 3*b*, the green bricks 1 are so loaded on the transport device 3 that their sidewalls 12 do not rest directly on the transport device 3 but indirectly via rods or bars 9 which in turn are held at a distance above the transport device 3 by carriers 9'. The carriers 9' have a L-shaped cross section, with the free ends of their legs resting upon the transport device 3 so that hot gases can also circulate underneath the green bricks 1, thereby ensuring a circulation of hot gases all-round the green bricks 1.

The burners 5 are preferably configured as high-speed burners that jet out produced combustion gases from the orifices 52 at particularly high core flow speed. Although, the core flow speed may be randomly selected, a speed of 30 to 60 m/s, preferably 40 to 50 m/s, has been shown appropriate. The hot gas stream produced by the burners 5 includes combustion gases which are generated in its core flow at a speed as set forth above. Within the mixing zone adjoining the cone-shaped core flow, the combustion gases induce an additional air flow in the furnace zone, i.e. air in the furnace zone is entrained to significantly increase the volume of the entire flow through the green bricks 1. The flow induction characteristic for high-speed burners generates a very intense hot gas stream at relative small combustion energy.

Referring now to FIG. 4, there is shown a detailed illustration of an exemplified burner 5 according to the present invention. The burner 5 includes an inner tube 7 which is received inside the concentric outer tube 6. The outer tube 6 has a lower portion to form the nozzle body 50, with the orifices 52 formed in the outer tube 6 in the area of the nozzle body 50. Below the orifices 52, the bottom end of the outer tube 6 is closed, preferably by a solid metal disk 14. The inner tube 7 has a bottom end which is positioned above the nozzle body 50 of the outer tube 6 and closed by a disk-shaped mixer 13. Burner gas, which already has been mixed with some fresh air, is supplied to the mixer 13 by a conduit 16 which extends in the area of the longitudinal axis 51 of the burner 5. Fresh air is supplied via a pipe connection 15, secured to the central tube 7, and the inner tube 7 to the mixer 13, which implements an intense mixture of burner gas and fresh air. An ignition electrode 17 extends beyond the mixer 13 toward the nozzle body 50 and is supplied with electric power via a line 18 which is guided through the inner tube 7 to the outside. An electric arc 19 is established between the electrode 17 and the mixer 13 to ignite the mixture of burner gas and fresh air. This mixture burns to a major degree inside the outer tube 6 at a level with the nozzle body 50, before exiting through the orifices 52. Still unburnt fractions of the mixture are burnt outside the outer tube 6.

It will be understood by persons skilled in the art that the configuration of the burner 5 is shown and described by way of example only and may vary from the configuration described herein so long as the longitudinal axes 53 of the orifices 52 extend in direction of the perforations 10.

While the invention has been illustrated and described as embodied in a tunnel kiln, and burner for use in a tunnel kiln, it is not intended to be limited to the details shown since various modifications and structural changes may be made without departing in any way from the spirit of the present invention.

What is claimed is:

1. A tunnel kiln useful for burning vertically perforated green bricks, comprising:

a furnace chamber;

a plurality of tubular burners for heating the furnace chamber, said burners defined by longitudinal axes which extend essentially in a vertical direction; and a transport device for so transporting green bricks in raster-like spaced-apart relationship in a travel direction through the furnace chamber that the perforations of the green bricks are oriented in a common direction, wherein each of the burners has a nozzle body formed with orifices for combustion gases, said orifices defined by longitudinal axes which extend substantially in a direction of the perforations, said nozzle body positioned within a spacing between confronting end faces of neighboring green bricks, wherein the burners are configured as high-speed burners and have a core flow speed of 30 to 60 m/s.

2. The tunnel kiln of claim 1 wherein the nozzle body has two groups of such orifices, said orifices of each of said groups arranged along a line, said groups of orifices being offset to one another by 180°.

3. The tunnel kiln of claim 1 wherein the perforations of all green bricks extend transversely to the travel direction.

4. The tunnel kiln of claim 1 wherein the burners have a core flow speed of 40 to 50 m/s.

5. The tunnel kiln of claim 1 wherein the nozzle body is sized sufficient to cover a height of the green bricks.

6. A tunnel kiln useful for burning vertically perforated green bricks, comprising:

a furnace chamber;

a plurality of tubular burners for heating the furnace chamber, said burners defined by longitudinal axes which extend essentially in a vertical direction; and a transport device for so transporting green bricks in raster-like spaced-apart relationship in a travel direction through the furnace chamber that the perforations of the green bricks are oriented in a common direction, wherein each of the burners has a nozzle body formed with orifices for combustion gases, said orifices defined by longitudinal axes which extend substantially in a direction of the perforations, said nozzle body positioned within a spacing between confronting end faces of neighboring green bricks, wherein each of the burners has an outer tube formed with the orifices and closed at its lower end in the area of the nozzle body, an inner tube received in the outer tube and having a lower end disposed above the nozzle body, and a disk-shaped mixer closing the lower end of the inner tube.

7. The tunnel kiln of claim 6 wherein the nozzle body is sized sufficient to cover a height of the green bricks.

8. The tunnel kiln of claim 6 wherein the nozzle body has two groups of such orifices, said orifices of each of said groups arranged along a line, said groups of orifices being offset to one another by 180°.

9. The tunnel kiln of claim 6 wherein the perforations of all green bricks extend transversely to the travel direction.

10. A tunnel kiln useful for burning vertically perforated green bricks, comprising:

a furnace chamber;

a plurality of tubular burners for heating the furnace chamber, said burners defined by longitudinal axes which extend essentially in a vertical direction; and a transport device for so transporting green bricks in raster-like spaced-apart relationship in a travel direction through the furnace chamber that the perforations of the green bricks are oriented in a common direction, wherein each of the burners has a nozzle body formed with orifices for combustion gases, said orifices defined by longitudinal axes which extend substantially in a direction of the perforations, said nozzle body positioned within a spacing between confronting end faces of neighboring green bricks, wherein the nozzle body is sized sufficient to cover a height of the green bricks and has a length of 340 mm with eight orifices.

11. The tunnel kiln of claim 10 wherein the orifices are evenly spaced.

12. The tunnel kiln of claim 10 wherein the orifices are irregularly spaced.

13. The tunnel kiln of claim 10 wherein the nozzle body has two groups of such orifices, said orifices of each of said groups arranged along a line, said groups of orifices being offset to one another by 180°.

14. The tunnel kiln of claim 10 wherein the perforations of all green bricks extend transversely to the travel direction.

* * * * *

UNITED STATES PATENT AND TRADEMARK OFFICE

CERTIFICATE OF CORRECTION

PATENT NO. : 6,572,369 B2
DATED : June 3, 2003
INVENTOR(S) : Walter Linke

It is certified that error appears in the above-identified patent and that said Letters Patent is hereby corrected as shown below:

Title page,
Item [75], correct Inventor's data as follows:
-- Walter Linke, Mauerbach (AT) --

Signed and Sealed this

Sixteenth Day of December, 2003

JAMES E. ROGAN
*Director of the United States Patent and Trademark Office*